US012546316B1

(12) United States Patent
Picouet

(10) Patent No.: US 12,546,316 B1
(45) Date of Patent: Feb. 10, 2026

(54) LOW RATIO OIL INJECTION PORT FOR APPLICATIONS WITHOUT THE REQUIREMENT OF AN OIL PUMP

(71) Applicant: Copeland Industrial LP, St. Louis, MO (US)

(72) Inventor: Jean-Louis Picouet, Waukesha, WI (US)

(73) Assignee: Copeland Industrial LP, St. Louis, MO (US)

( * ) Notice: Subject to any disclaimer, the term of this patent is extended or adjusted under 35 U.S.C. 154(b) by 0 days.

(21) Appl. No.: 18/796,746

(22) Filed: Aug. 7, 2024

(51) Int. Cl.
*F04C 18/16* (2006.01)
*F04C 29/04* (2006.01)

(52) U.S. Cl.
CPC ..... *F04C 18/16* (2013.01); *F04C 29/042* (2013.01); *F04C 2210/206* (2013.01)

(58) Field of Classification Search
CPC ... F04C 18/16; F04C 29/042; F04C 2210/206
See application file for complete search history.

(56) References Cited

U.S. PATENT DOCUMENTS 5,653,585 A * 8/1997 Fresco ..... F25B 1/047 418/94
8,491,280 B2 7/2013 Kameya et al.
8,708,677 B2 * 4/2014 Gotou ..... F04C 18/52 418/91
8,858,192 B2 * 10/2014 Shikano ..... F04C 29/028 418/195
2010/0329918 A1 * 12/2010 Gotou ..... F04C 29/042 418/195
2013/0129553 A1 * 5/2013 Picouet ..... F04C 18/084 418/195
2020/0003211 A1 * 1/2020 Miyamura ..... F04C 18/52

FOREIGN PATENT DOCUMENTS

EP 3505765 B1 4/2020
GB 2486503 A * 6/2012 ..... F01C 21/001
WO 2013078132 A1 5/2013

OTHER PUBLICATIONS

Stosic, N.; Milutinovic, L.; Hanjalic, K.; and Kovacevic, A., "Experimental Investigation of the Influnce of Oil Injection Upon theScrew Compressor Working Process" (1990). International Compressor Engineering Conference. Paper 687. https://docs.lib.purdue.edu/icec/687.

S Randi et al; "Numerical analysis of oil injection effects in a single screw expander"; 2018 IOP Conf. Ser.: Mater. Sci. Eng. 425 012001.

* cited by examiner

*Primary Examiner* — J. T. Newton
(74) *Attorney, Agent, or Firm* — Amundsen Davis, LLC

(57) ABSTRACT

Screw compressors and screw compressor systems are disclosed in which the compressors include an oil injection port that injects oil into the compression chamber during a compression cycle. The oil injection port is located in an outer wall of the cylindrical bore within the compressor housing in which the main rotor is rotationally mounted. The oil injection port is located and configured to inject oil into the compression chamber during a time period such that the average pressure ratio of the pressure of the compression gasses within the compression chamber relative to the suction pressure during the time period is reduced as compared to standard compressors. The design of the oil injection port allows screw compressor systems to not include an oil pump.

18 Claims, 10 Drawing Sheets

LOW RATIO OIL INJECTION PORT FOR APPLICATIONS WITHOUT THE REQUIREMENT OF AN OIL PUMP

FIELD OF THE INVENTION

The present technology relates to compressor systems, compressors and oil injection ports for compressors, and more particularly to compressors having oil injection ports that provide low average pressure ratios of the pressure of the compression gasses within the compression chamber relative to the suction pressure during oil injection.

BACKGROUND

Compressors, for example rotary screw gas compressors, are used in many applications, including for example in refrigeration systems to compress refrigerant gas, such as "Freon", ammonia, natural gas, or the like. One type of rotary gas compressor employs a housing in which a motor-driven single main rotor having helical grooves that define gas compression chambers and that mesh with the teeth of a pair of gates, or star rotors on opposite sides of the rotor.

During operation of such single screw compressors, the compressors need cooling in order to avoid overheating. The cooling media, which is typically oil, is sent into the compressor compression chambers through oil injection holes. There are typically two oil injection holes, and those holes are located in such a way that the oil starts to enter the compression chamber once the compression chamber is closed by the gate rotor tooth. This means that the oil will enter the compression chamber at the start of compression, when there is a pressure ratio of the pressure of the compression gasses relative to the suction pressure of 1:1. The known oil injection holes are also located in such a way that the oil will stop flowing during a compression cycle when the pressure ratio of the pressure of the compression gasses relative to the suction pressure is around 3.6:1. Accordingly, the average pressure ratio of the pressure of the compression gasses relative to the suction pressure when oil is being injected into the compression chamber during a compression cycle is about 1.8:1.

Such operating conditions require compressor systems to include an oil pump to send the oil into the compression chamber, particularly during the winter months when the condensing pressure tends to drop due to the colder outside temperature. Without an oil pump, there is rick that the flow of oil will be reversed, which would cause the compressor to overheat and may cause irreversible damages.

SUMMARY

Disclosed herein are compressor systems and compressors having oil injection ports, as well as methods of operating such compressors, that provide low average pressure ratios of the pressure of the compression gasses within the compression chamber relative to the suction pressure during oil injection.

In a first aspect, a screw compressor is provided. The screw compressor includes a compressor housing, a main rotor, a gate rotor, and an oil injection port. The compressor housing includes a cylindrical bore having an outer wall. The outer wall of the cylindrical bore includes an oil injection port. The main rotor is rotationally mounted within the cylindrical bore of the compressor housing. The main rotor includes at least one helical groove that defines a compression chamber. The gate rotor has a gear tooth that closes the compression chamber at a start of a compression cycle, travels through the compression chamber during the compression cycle, and exits the compression chamber at an end of the compression cycle. Compression gasses within the compression chamber have a pressure, the pressure being equal to suction pressure at the start of the compression cycle and increasing during the compression cycle to a discharge pressure at the end of the compression cycle. The oil injection port that injects oil into the compression chamber during a time period, and an average pressure ratio of the pressure of the compression gasses within the compression chamber relative to the suction pressure during the time period is less than 1.8:1.

In a second aspect, a compression system is provided that includes an oil cooler, an oil separator, and a screw compressor. The oil cooler cools oil to be injected into a screw compressor. The oil separator separates oil from compression gasses generated by the screw compressor. The screw compressor includes a compressor housing, a main rotor, a gate rotor, and an oil injection port. The compressor housing includes a cylindrical bore having an outer wall. The outer wall of the cylindrical bore includes an oil injection port. The main rotor is rotationally mounted within the cylindrical bore of the compressor housing. The main rotor includes at least one helical groove that defines a compression chamber. The gate rotor has a gear tooth that closes the compression chamber at a start of a compression cycle, travels through the compression chamber during the compression cycle, and exits the compression chamber at an end of the compression cycle. Compression gasses within the compression chamber have a pressure, the pressure being equal to suction pressure at the start of the compression cycle and increasing during the compression cycle to a discharge pressure at the end of the compression cycle. The oil injection port that injects oil into the compression chamber during a time period, and an average pressure ratio of the pressure of the compression gasses within the compression chamber relative to the suction pressure during the time period is less than 1.8:1. In at least some examples, the compression system may not include an oil pump.

The screw compressor in either the first aspect or the second aspect as described above may include one or more additional features. For example, the main rotor may include a plurality of helical grooves and each helical groove defines a compression chamber. Additionally, the compressor may comprise two gate rotors, the first gate rotor being rotationally mounted within the compressor housing on a first side of the main rotor and the second gate rotor being rotationally mounted within the compressor housing on a second side of the main rotor opposite the first side. As another example, the average pressure ratio of the pressure of the compression gasses within the compression chamber relative to the suction pressure during the time period may be about 1.2:1. Further, the time period during which the oil injection port injects oil into the compression chamber may begin prior to when the gear tooth closes the compression chamber at the start of a compression cycle. Moreover, the pressure ratio of the pressure of the compression gasses within the compression chamber relative to the suction pressure may be about 2.4:1 when the time period during which the oil injection port injects oil into the compression chamber ends. As yet another example, the oil injection port may include a single injection point, and may not include a plurality of oil injection points.

In a third aspect, a method of operating a screw compressor is provided. The method includes providing a screw compressor, which may be of the type described above with respect to the first and second aspects. The screw compressor includes a compressor housing, a main rotor, a gate rotor, and an oil injection port. The compressor housing includes a cylindrical bore having an outer wall. The outer wall of the cylindrical bore includes an oil injection port. The main rotor is rotationally mounted within the cylindrical bore of the compressor housing. The main rotor includes at least one helical groove that defines a compression chamber. The gate rotor has a gear tooth that closes the compression chamber at a start of a compression cycle, travels through the compression chamber during the compression cycle, and exits the compression chamber at an end of the compression cycle. Compression gasses within the compression chamber have a pressure, the pressure being equal to suction pressure at the start of the compression cycle and increasing during the compression cycle to a discharge pressure at the end of the compression cycle. The method also includes injecting oil into the compression chamber through the oil injection port during a time period, wherein an average pressure ratio of the pressure of the compression gasses within the compression chamber relative to the suction pressure during the time period is less than 1.8:1. Injecting oil into the compression chamber through the oil injection port during the time period may include beginning the time period prior to when the gear tooth closes the compression chamber at the start of a compression cycle. Further, injecting oil into the compression chamber through the oil injection port during the time period may include ending the time period when a pressure ratio of the pressure of the compression gasses within the compression chamber relative to the suction pressure is about 2.4:1.

BRIEF DESCRIPTION OF THE DRAWINGS

Specific examples have been chosen for purposes of illustration and description, and are shown in the accompanying drawings, forming a part of the specification.

Figure 1:
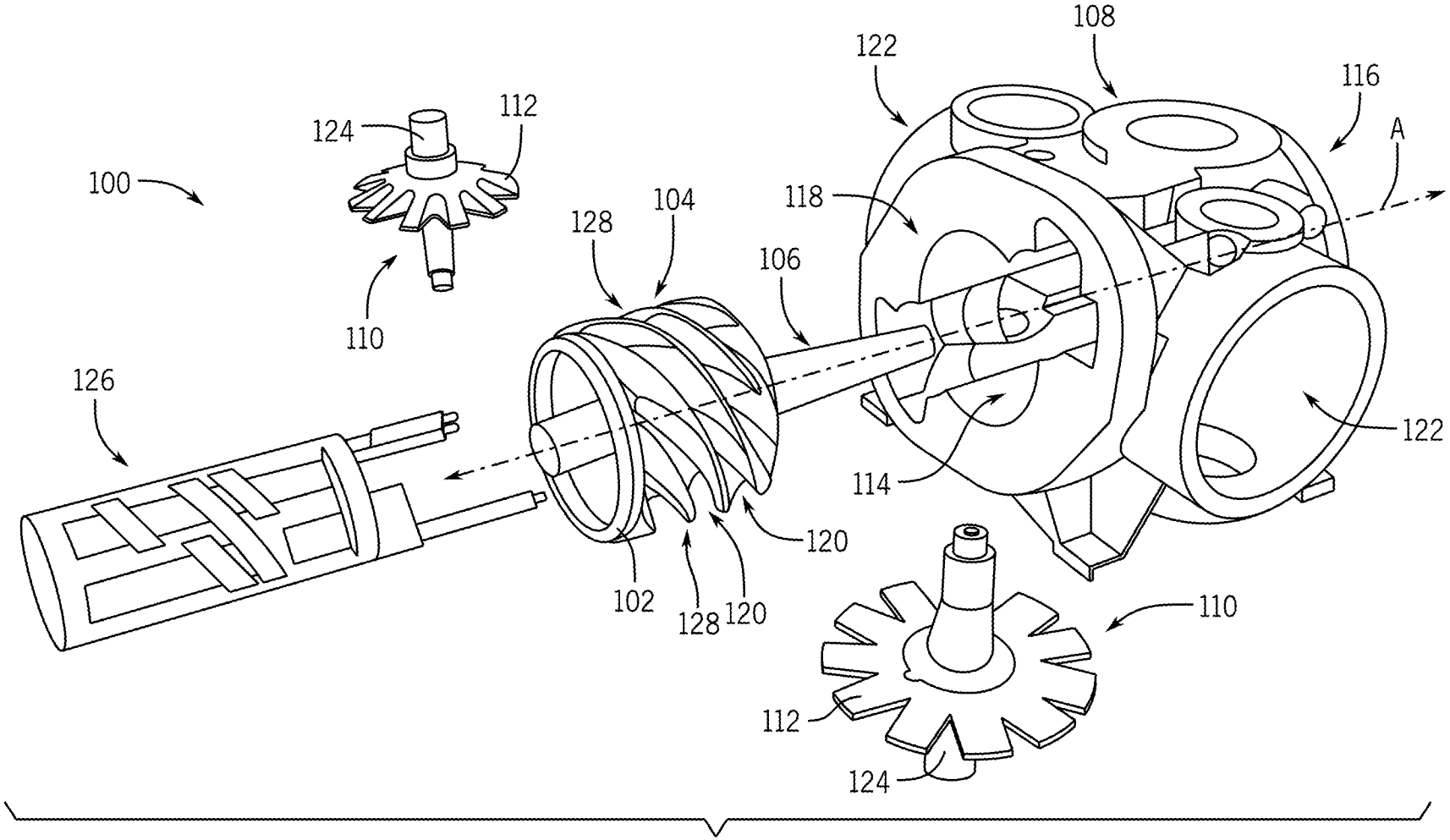
FIG. 1 illustrates an exploded view of a single screw compressor of the present technology.

While various embodiments discussed herein are amenable to modifications and alternative forms, aspects thereof have been shown by way of example in the drawings and are described in detail herein. It should be understood, however, that the disclosure is not limited to the particular embodiments described, and instead is meant to include all modifications, equivalents, and alternatives falling within the scope of the disclosure. In addition, the terms "example" and "embodiment" as used throughout this application is only by way of illustration, and not limitation. The term "about" with respect to a measurement as used herein means the stated measurement plus or minus a 10% margin of error. The term "configured to" as used herein with respect to a component being "configured to" have certain structural characteristics in specified circumstances or to perform a function means that the component is structurally formed such that the component meets the structural characteristics in the specified circumstances or performs the function without further modification. The Figures are not necessarily drawn to scale. The use of the same reference symbols in different drawings indicates similar or identical items unless otherwise noted.

DETAILED DESCRIPTION

Compressors of the present technology have oil injection ports that are designed and configured to inject oil into a compression chamber during a time period. Preferably, the oil injection ports are designed and configured to inject oil into a compression chamber during a time period that results in the average pressure ratio of the pressure of the compression gasses within the compression chamber relative to the suction pressure during the time period being reduced as compared to conventional compressors. Benefits may include eliminating the need for the compressor system to include an oil pump to send the oil into the compression chamber, even in the winter months when the condensing pressure tends to drop due to the colder outside temperature, while maintaining compressor efficiency. Elimination of the oil pump may include savings of the additional costs and complexity to install an oil pump just to be able to operate the units during the winter months, or when low condensing pressure is present. Elimination of the oil pump may also save power that would otherwise be used by the oil pump motor and be a more sustainable overall system for customers.

Figure 2:
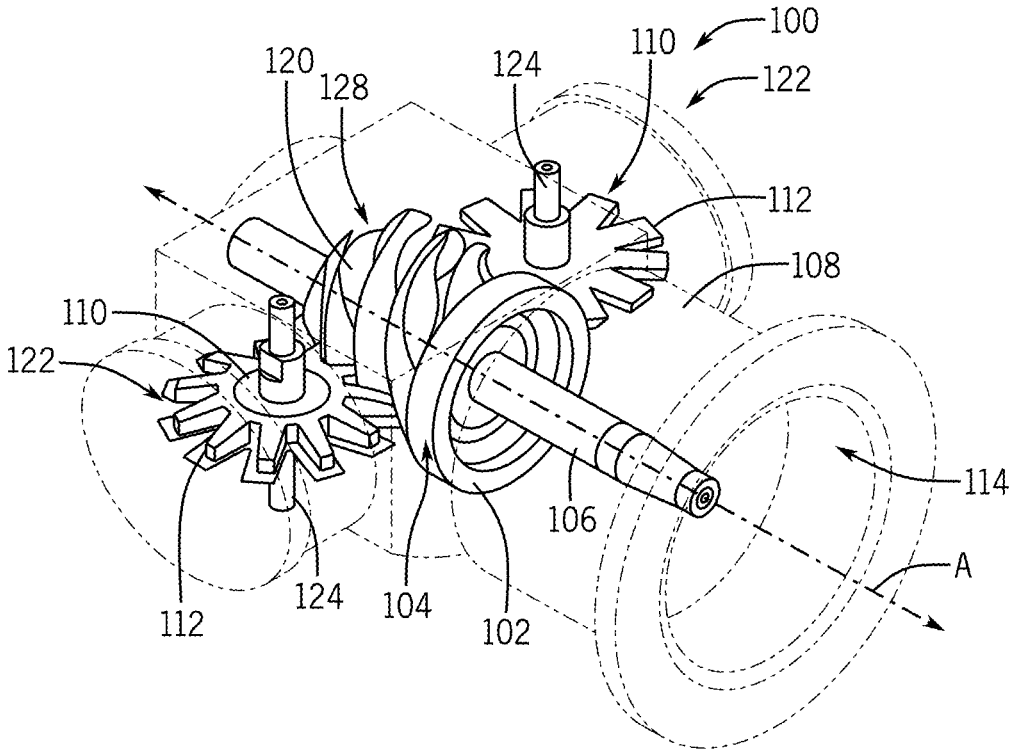
FIG. 2 is a partial view of the single screw compressor of FIG. 1, showing the placement of the main rotor and gate rotor components of the single screw compressor within the housing.

FIGS. 1 and 2 illustrate one example of a compressor 100 of the present technology. In the illustrated example, the compressor 100 is a rotary gas compressor for a refrigeration system, and is specifically a single screw rotary gas compressor. The compressor 100 has a main rotor 102, which has a cylindrical outer surface 104 that is helically grooved and a rotor shaft 106. The rotor shaft 106 extends axially along a schematic central axis A. Compressor 100 also includes a compressor housing 108, and the main rotor 102 is mounted for rotation about the rotor shaft 106 within the compressor housing 108. At least one gate rotor 110 also mounted for rotation in the compressor housing 108. In the illustrated example, there are a pair of gate rotors 110 that are each mounted for rotation in the compressor housing 108. Each gate rotor 110 has at least one gear tooth 112, and as illustrated each gate rotor 110 has a plurality of gear teeth 112.

As shown in FIG. 1, the compressor housing 108 generally includes a cylindrical bore 114 in which the main rotor is rotatably mounted. The cylindrical bore 114 may be open at its suction end 116 and may be closed at its discharge end 118 by a discharge end wall (not shown).

Referring to FIGS. 1 and 2, the rotor shaft 106 of the main rotor 102 is rotatably supported at opposite ends on bearing assemblies (not shown) mounted on compressor housing 108. Accordingly, the main rotor 102 is rotationally mounted within the cylindrical bore 114 of the compressor housing 108. The main rotor 102 includes at least one helical groove 120, and as shown includes a plurality of helical grooves 120. Each helical groove 120 of the main rotor 102 defines a compression chamber 128.

As illustrated, the compressor housing 108 may also include at least one gate rotor chamber 122 therein, in which the at least gate rotor 110 is rotatably mounted. In the illustrated embodiment, the compressor 100 includes two gate rotors 110, the first gate rotor 110 is rotationally mounted within the compressor housing 108 on a first side of the main rotor and the second gate rotor 110 is rotationally mounted within the compressor housing 108 on a second side of the main rotor that is opposite the first side. Accordingly, the gate rotors 110 are located on opposite sides (i.e., 180 degrees apart) of main rotor 102. Each gate rotor 110 has a gate rotor shaft 124 that is rotatably supported at opposite ends on the bearing assemblies (not shown) mounted on the compressor housing 108. Each of the gate rotors 110 typically rotate on a schematic axis which is perpendicular to and spaced from the schematic central axis A of main rotor 102 (the axis of rotation of the main rotor 102) and its gear teeth 112 extend through an opening in the gate rotor chamber 122 that communicates with cylindrical bore 114.

As shown in FIG. 1, the compressor 100 may also include at least one, and generally two, dual slide valve assemblies 126, which are mounted inside the compressor housing 108 and cooperate with the main rotor 102 to control gas flow into and from the compression chambers 128 formed by the helical grooves 120 on the main rotor 102.

Figure 3:
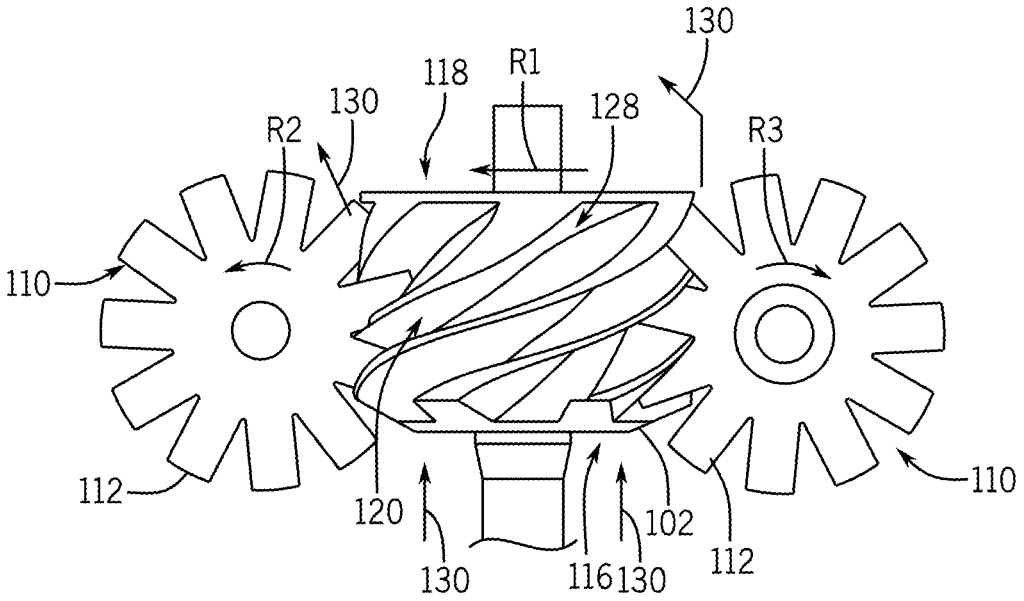
FIG. 3 is a top view of the main rotor and gate rotor components of the single screw compressor of FIG. 1.

FIG. 3 illustrates the main rotor 102 and gate rotor 110 components of the single screw compressor of FIGS. 1 and 2. During operation, the main rotor 102 and each gate rotor 110 all rotate as shown in FIG. 3. The main rotor 102 rotates into the page in the direction R1. The gate rotors 110 rotate in opposite directions with respect to each other. As shown, the first gate rotor 110 rotates counterclockwise in direction R2, and the second gate rotor rotate clockwise in the direction R3.

Referring to FIGS. 1 through 3, for a given compression chamber 128 defined by a helical groove 120 of the main rotor 102, a gear tooth 112 of the gate rotor 110 closes the compression chamber 128 at a start of a compression cycle, travels through the compression chamber 128 during the compression cycle, and exits the compression chamber 128 at an end of the compression cycle. Each gear tooth 112 of each of the gate rotors 110 successively engages a helical groove 120 in main rotor 102 as the latter is rotatably driven by a motor. Referring to FIG. 3, compression gasses 130 enter a helical groove 120, and thus a compression chamber 128 of the compressor 100, at the suction end 116 at the start of the compression cycle. The compression gasses 130 have a pressure that is equal to suction pressure when they enter the compression chamber 128 As the gear tooth 112 of the gate rotor 110 travels through the compression chamber 128 during the compression cycle, the gasses are compressed, which causes the pressure of the compression gasses 130 to increase. At the end of the compression cycle, the compression gasses 130 exit the compression chamber 128 at a discharge pressure. Accordingly, compression gasses 130 within the compression chamber 128 have a pressure that is equal to suction pressure at the start of the compression cycle, and that increases during the compression cycle to a discharge pressure at the end of the compression cycle.

Figure 4:
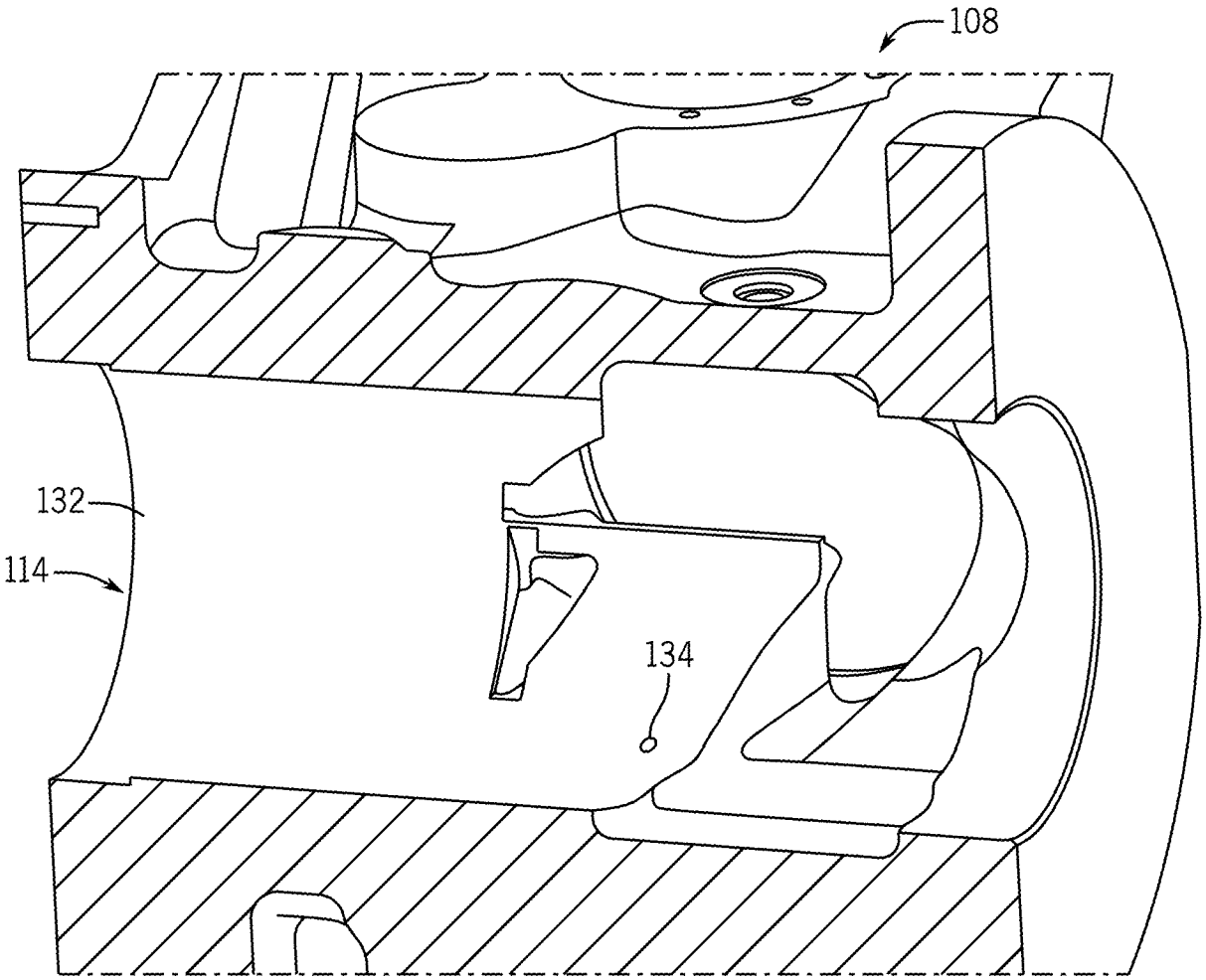
FIG. 4 illustrates a cross-sectional view of one example of a compressor housing of the present technology, including an oil injection port of the present technology.
Figure 5:
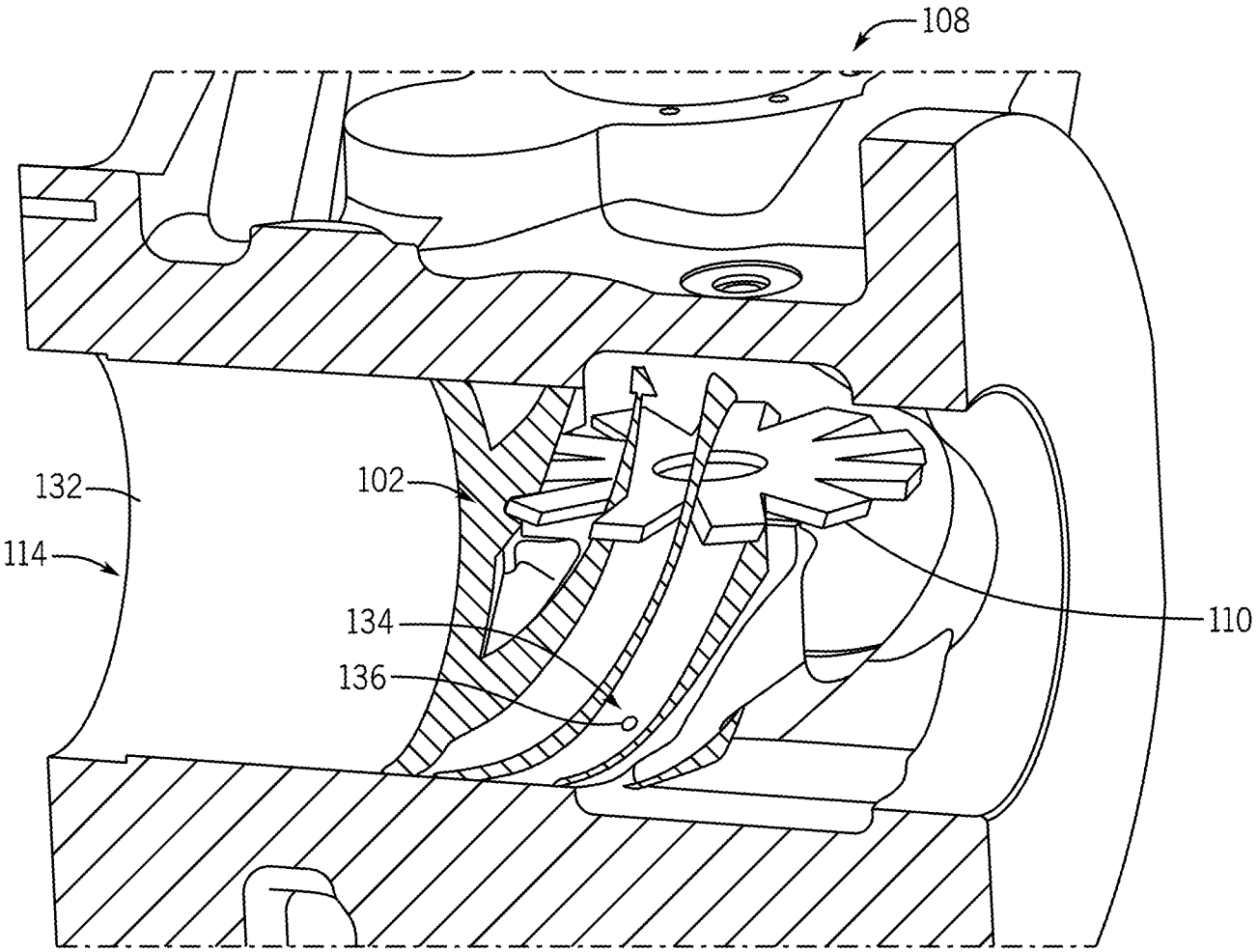
FIG. 5 illustrates the cross-sectional view of FIG. 4, with representations of a gate rotor and portions of the outer surface of the main rotor included.

FIGS. 4 and 5 illustrate a cross-sectional view of one example of a compressor housing 108 of the present technology, including an oil injection port of the present technology. FIG. 4 shows only the cross-sectional view of the compressor housing 108, while FIG. 5 includes representations of a gate rotor 110 and portions of the outer surface of the main rotor 102 for context. As shown, the compressor housing 108 includes a cylindrical bore 114 that has an outer wall 132. The outer wall 132 of the cylindrical bore 114 includes an oil injection port 134 that has an oil injection point 136. The oil injection port 134 that injects oil into the compression chamber 128 through the oil injection point 136 during a time period during operation of the compressor 100 (FIGS. 1 and 2). The oil injection port 134 includes a single injection point 136, and does not include a plurality of oil injection points.

Figure 6:
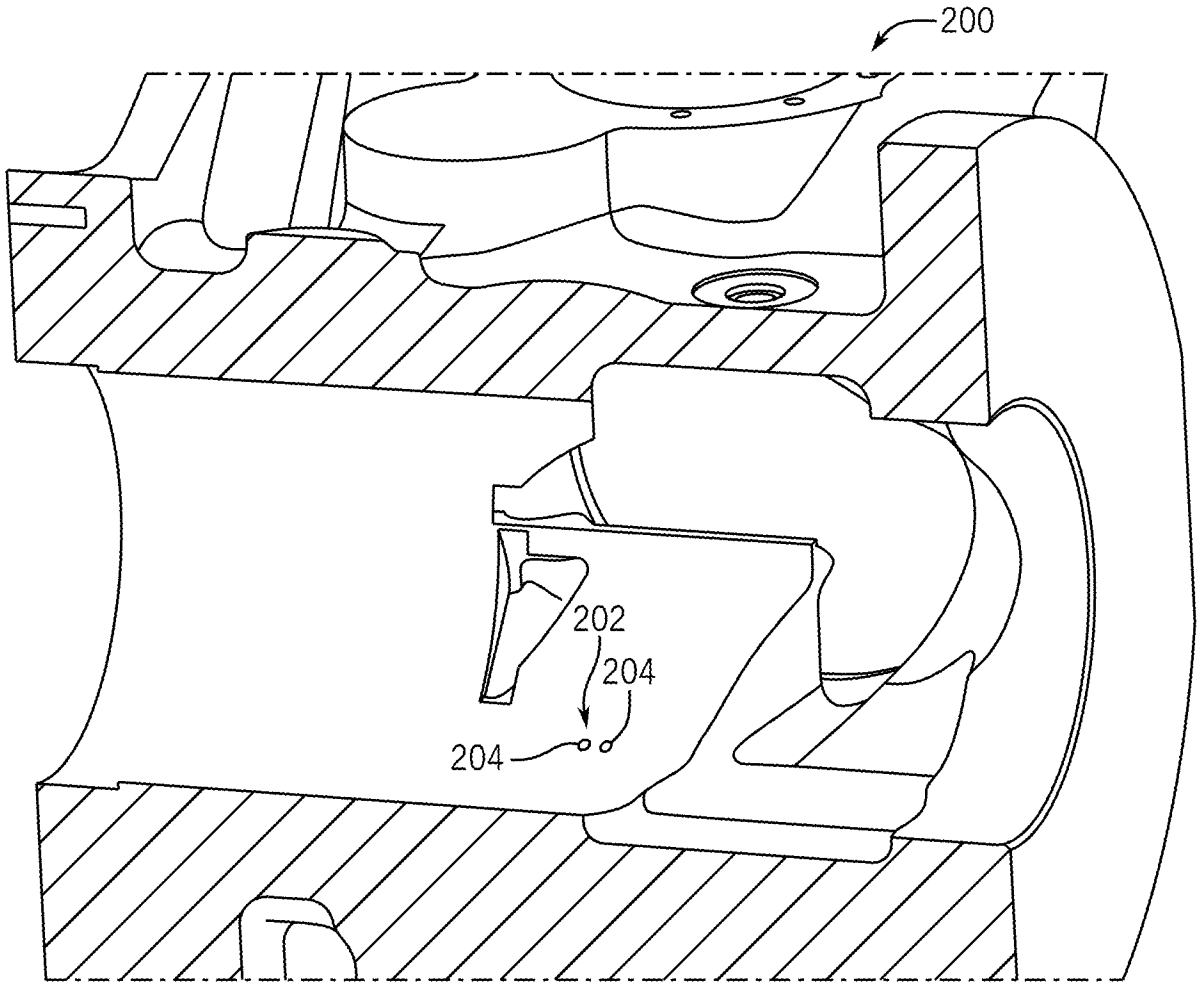
FIG. 6 PRIOR ART
FIG. 6 illustrates a cross-sectional view of one example of a prior art compressor housing including a prior art oil injection port.

For comparison, FIG. 6 illustrates a cross-sectional view of one example of a prior art compressor housing 200, having a prior art oil injection port 202. The prior art oil injection port 202 has a plurality of oil injection points 204. Specifically, the prior art oil injection port 202 has two oil injection points 204. The oil injection points 204 are each smaller in diameter, and surface area, than the oil injection point 136. The single oil injection point 136 (FIGS. 4 and 5) of the present technology may have any suitable dimensions, and may vary depending on the type of compressor and various compressor parameters such as capacity. In at least one example, the single oil injection point 136 (FIGS. 4 and 5) may have a surface area that is equal to, or substantially equal to, the combined surface area of the two oil injection points 204.

Figure 7:
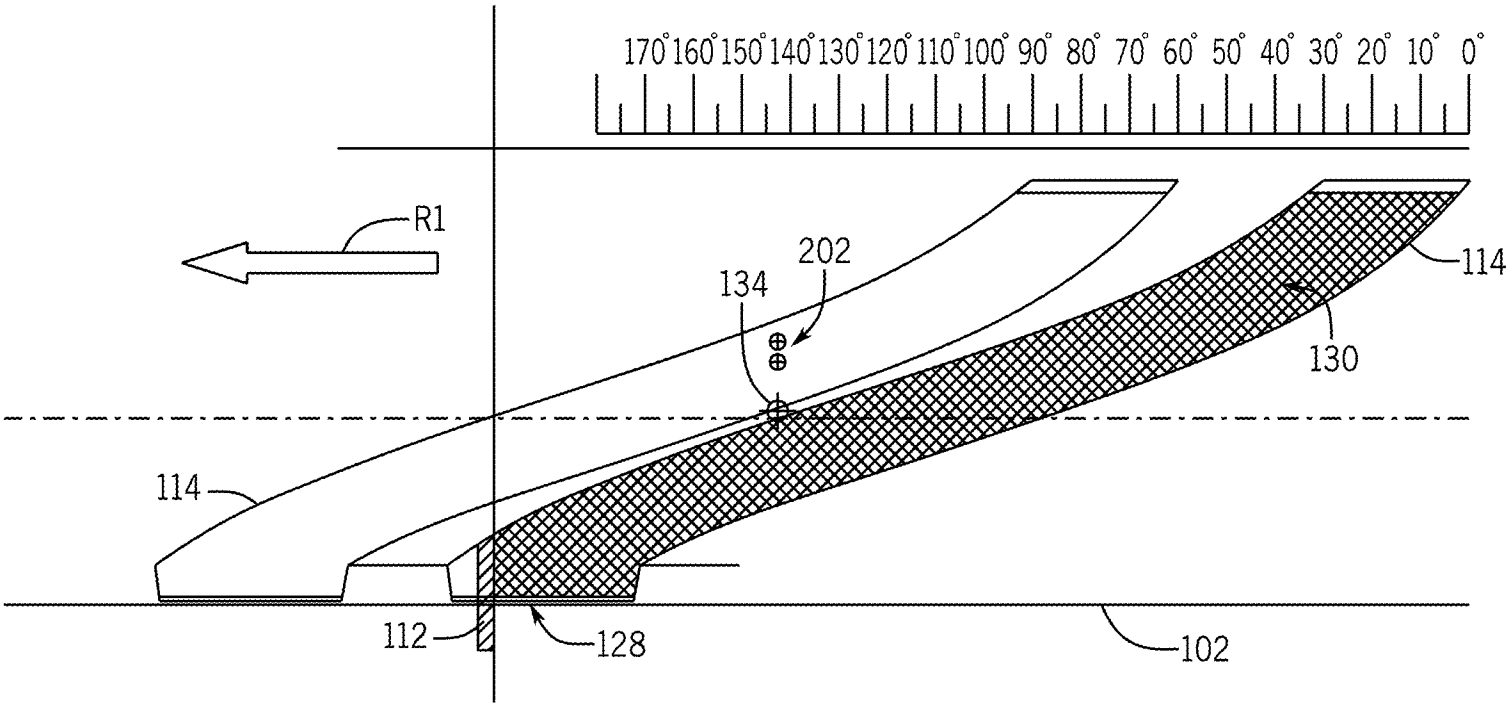
FIG. 7 illustrates a two-dimensional view of the layout of two of the helical grooves of the main rotor of FIGS. 1-3, at a first point in time.
Figure 8:
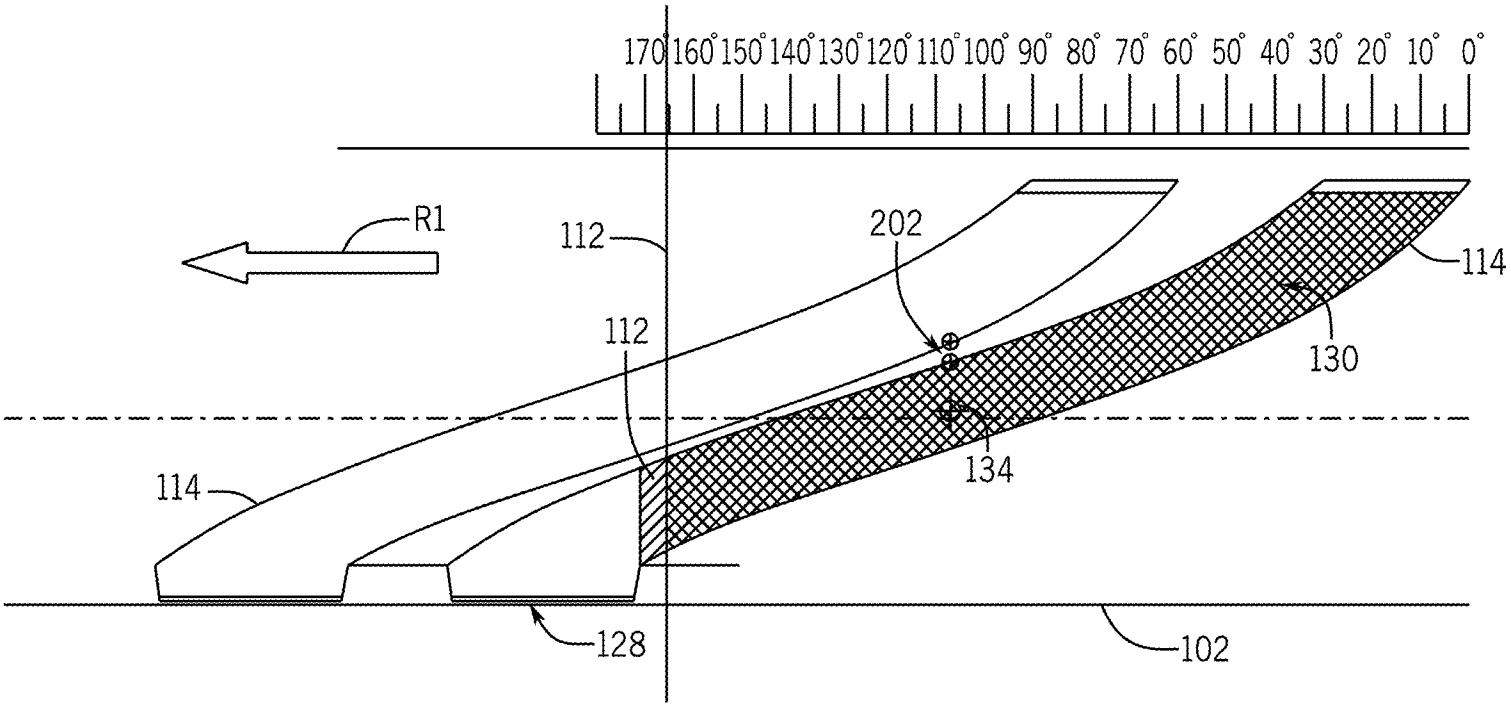
FIG. 8 illustrates the two-dimensional view of the layout of FIG. 7, at a second point in time.
Figure 9:
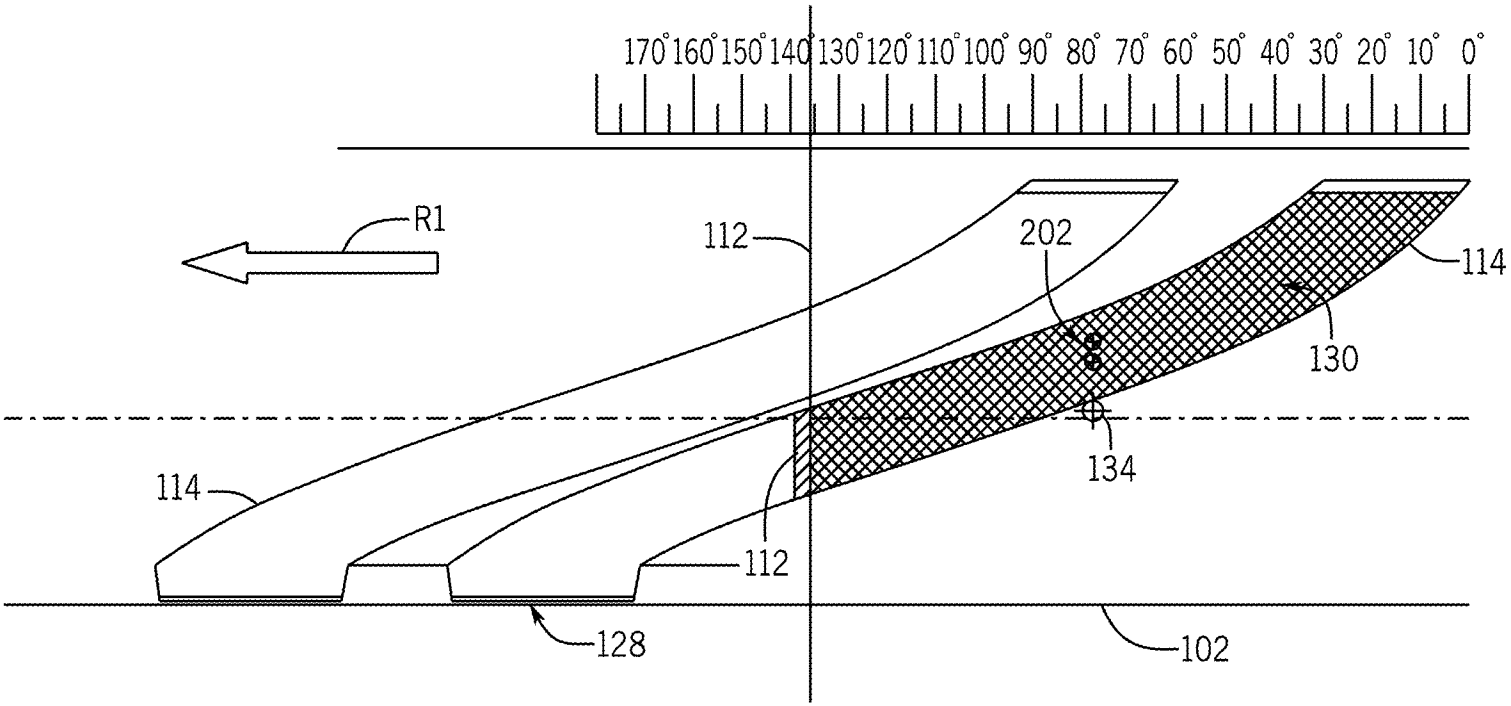
FIG. 9 illustrates the two-dimensional view of the layout of FIG. 7, at a third point in time.

FIGS. 7 through 9 illustrate a two-dimensional view of the layout of two of the helical grooves 114 of the main rotor 102. FIG. 7 shows the layout at a first point in time, FIG. 8 shows the layout at a second point in time, and FIG. 9 shows the layout at a third point in time. With reference to FIGS. 3 and 7 though 9, the main rotor 102 rotates in the direction R1. In FIGS. 7 through 9, the cross-hashing represents compression gasses 130 within the compression chamber 128. The diagonal hashing represents a gear tooth 112 in one of the grooves 114. The oil injection port 134 is shown, and for comparison, the prior art oil injection port 202 is also shown. Generally, an oil injection port can only inject oil into the compression chamber 128 when the oil injection port is aligned with the compression chamber 128 in the views shown in FIGS. 7 through 9, since any oil injected when the oil injection port is not aligned with the compression chamber 128 would not go into the compression chamber 128. The angle measurements across the top show the degree of rotation of the grooves 114 over time.

The first point in time shown in FIG. 7 is prior to what is typically thought of as being the start of the compression cycle. At the first point in time shown in FIG. 7, the gear tooth 112 has not yet closed off the compression chamber 128. However, the oil injection port 134 is at a beginning point of being aligned with the compression chamber 128, and will start to inject oil into the compression chamber 128. Thus, the time period during which the oil injection port 134 injects oil into the compression chamber 128 begins prior to when the gear tooth 112 closes the compression chamber 128 at the start of a compression cycle. It is believed that most of the oil will stay confined within the compression chamber until the gear tooth 112 closes the compression chamber. In contrast, the prior art injection port 202 is not yet aligned with the compression chamber 128 in the first point in time illustrated in FIG. 7. At the first point in time shown in FIG. 7, the pressure ratio of the compressed gasses 130 compared to suction pressure will be 1:1. In other words, prior to the start of the compression cycle, the compression gasses 130 have their initial pressure, which is equal to suction pressure, because they have not yet been compressed.

The second point in time shown in FIG. 8 is when the gear tooth 112 closes off the compression chamber 128, which typically thought of as being the start of the compression cycle. At the second point in time shown in FIG. 8, the pressure ratio of the compressed gasses 130 compared to suction pressure is still 1:1. In other words, at the start of the compression cycle, the compression gasses 130 still have their initial pressure, which is equal to suction pressure, because they have not yet been compressed. At this second point in time, the oil injection port 134 is about halfway or more than halfway through the time period in which it is aligned with the compression chamber 128 and injects oil into the compression chamber 128. In contrast, the prior art oil injection port 202 is at a beginning point of being aligned with the compression chamber 128, and will start to inject oil into the compression chamber 128.

The third point in time shown in FIG. 9 is a point in time that is partially through the compression cycle. At the third point in time, the oil injection port 134 is at an end of its time period of being in alignment with the compression chamber 128, and thus stops injecting oil into the compression chamber 128. At the third point in time, the pressure ratio of the compressed gasses 130 compared to suction pressure is greater than 1:1, because the compression gasses are being compressed and thus have an increased pressure as compared to suction pressure. The compression gasses 130 are not yet at discharge pressure, because the compression cycle has not ended and the compression gasses 130 are still being compressed. The oil injection port 134 is located and configured such that the pressure ratio of the pressure of the compression gasses 130 within the compression chamber 128 relative to the suction pressure is a desired ratio, at least at a predetermined temperature, when the time period during which the oil injection port 134 injects oil into the compression chamber 128 ends. In at least one example, the oil injection port 134 may be located and configured such that the pressure ratio of the pressure of the compression gasses 130 within the compression chamber 128 relative to the suction pressure is about 2.4:1 when the time period during which the oil injection port 134 injects oil into the compression chamber 128 ends.

In contrast, at the third point in time, the prior art oil injection port 202 is still injecting oil into the compression chamber, and continues to do so until a later point in time (not shown). The pressure ratio of the pressure of the compression gasses 130 within the compression chamber 128 relative to the suction pressure when the prior art injection port 202 stops injecting oil into the compression chamber 128 is thus higher than the pressure ratio of the pressure of the compression gasses 130 within the compression chamber 128 relative to the suction pressure when the oil injection port 134 stops injecting oil into the compression chamber.

For the time period in which the oil injection port 134 injects oil into the compression chamber 128, the starting pressure ratio of the pressure of the compression gasses 130 within the compression chamber 128 relative to the suction pressure of 1:1 at the first point in time, the pressure ratio increases during the period of time, and then there is a final pressure ratio of the pressure of the compression gasses 130 within the compression chamber 128 relative to the suction pressure. The average pressure ratio of the pressure of the compression gasses 130 within the compression chamber 128 relative to the suction pressure during the time period in which the oil injection port 134 injects oil into the compression chamber 128 can thus be calculated. The oil injection port 134 may be located and configured to provide a desired average pressure ratio of the compression gasses 130 within the compression chamber 128 relative to the suction pressure during the time period in which the oil injection port 134 injects oil into the compression chamber 128, at least at a predetermined temperature. In at least one example, the oil injection port 134 may be located and configured to provide an average pressure ratio of the compression gasses 130 within the compression chamber 128 relative to the suction pressure of about 1.2:1 during the time period in which the oil injection port 134 injects oil into the compression chamber 128.

In contrast, the average pressure ratio of the compression gasses 130 within the compression chamber 128 relative to the suction pressure during the time period in which the prior art oil injection port 202 injects oil into the compression chamber 128 will be higher than for oil injection port 134, since the prior art oil injection port 202 does not stop injecting oil into the compression chamber 128 until the compression gasses 130 are at a higher pressure.

Figure 10:
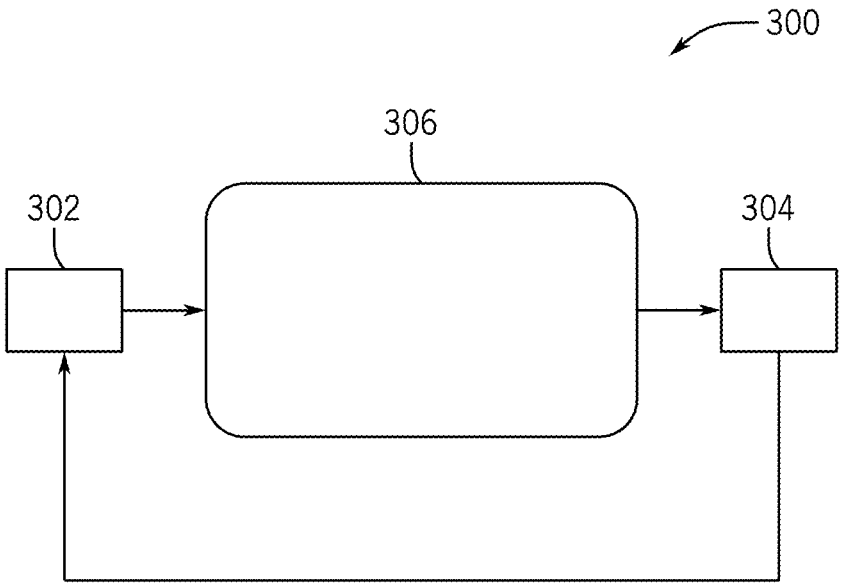
FIG. 10 illustrates one example of a compressor system of the present technology.

FIG. 10 illustrates one example of a compressor system 300 of the present technology. The compressor system 300 includes a compressor 302, which as shown is a single screw compressor. The compressor 302 may be of the type described above with respect to single screw compressor 100, and may have any of the features and functions described above with respect to screw compressor 100. The system 300 also includes an oil cooler 304 that cools oil to be injected into a screw compressor. The system 300 further includes an oil separator 306 that separates oil from compression gasses generated by the screw compressor. Significantly, the compression system 300 does not include an oil pump.

Figure 11:
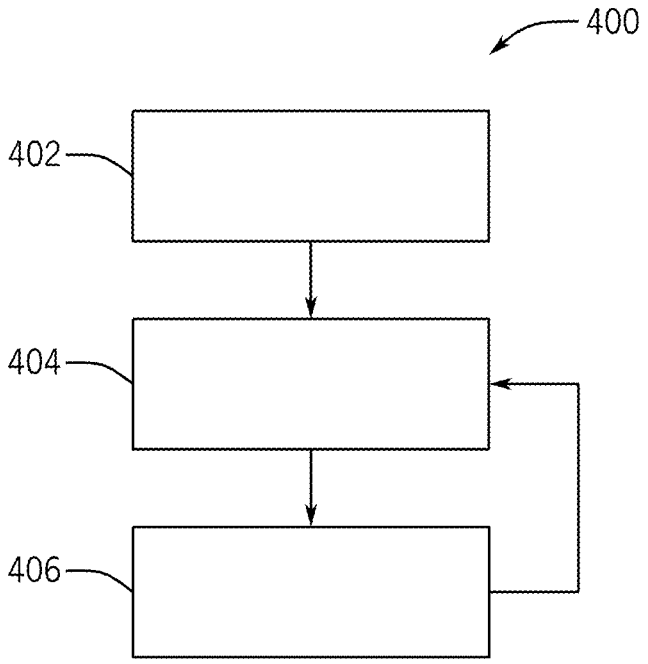
FIG. 11 illustrates one example of a method of operating a screw compressor of the present technology.

FIG. 11 illustrates one example of a method 400 of operating a screw compressor of the present technology. The method 400 starts at step 402, which includes providing a single screw compressor. The single screw compressor may be of the type described above with respect to single screw compressor 100, and may have any of the features and functions described above with respect to screw compressor 100. Additionally, the compressor provided may be a component of a compressor system 300, and may have any of the features and functions described above with respect to compressor system 300. The provided screw compressor includes at least a compressor housing, a main rotor, a gate rotor, and an oil injection port. The compressor housing includes a cylindrical bore having an outer wall. The outer wall of the cylindrical bore includes an oil injection port. The main rotor is rotationally mounted within the cylindrical bore of the compressor housing. The main rotor includes at least one helical groove that defines a compression chamber. The gate rotor has a gear tooth that closes the compression chamber at a start of a compression cycle, travels through the compression chamber during the compression cycle, and exits the compression chamber at an end of the compression cycle. Compression gasses within the compression chamber have a pressure, the pressure being equal to suction pressure at the start of the compression cycle and increasing during the compression cycle to a discharge pressure at the end of the compression cycle.

The method 400 continues to step 404, which includes conducting a compression cycle, wherein compression gasses within the compression chamber have a pressure, the pressure being equal to suction pressure at the start of the compression cycle and increasing during the compression cycle to a discharge pressure at the end of the compression cycle.

The method 400 continues to step 406, which includes injecting oil into the compression chamber through the oil injection port during a time period, wherein an average pressure ratio of the pressure of the compression gasses within the compression chamber relative to the suction pressure during the time period is less than 1.8:1. As discussed above, it may be preferable for the average pressure ratio of the pressure of the compression gasses within the compression chamber relative to the suction pressure during the time period to be about 1.2:1. Thus, in at least some examples of the method, step 406 may include injecting oil into the compression chamber through the oil injection port during a time period, wherein an average pressure ratio of the pressure of the compression gasses within the compression chamber relative to the suction pressure during the time period is about 1.2:1.

With respect to step 406, injecting oil into the compression chamber through the oil injection port during the time period may include beginning the time period prior to when the gear tooth closes the compression chamber at the start of a compression cycle. Further, injecting oil into the compression chamber through the oil injection port during the time period may include ending the time period when a pressure ratio of the pressure of the compression gasses within the compression chamber relative to the suction pressure is about 2.4:1.

Although steps 404 and 406 are described as separate steps, it should be understood that they are performed in an overlapping manner. Specifically, step 406, injecting the oil, occurs prior to and during the compression cycle of step 404.

Additionally, operation of a compressor in a compressor system includes running multiple compression cycles in succession. Accordingly, the method may include conducting steps 404 and 406 multiple times in succession.

From the foregoing, it will be appreciated that although specific examples have been described herein for purposes of illustration, various modifications can be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A screw compressor comprising:

a compressor housing that includes a cylindrical bore having an outer wall;

a main rotor rotationally mounted within the cylindrical bore of the compressor housing, the main rotor including at least one helical groove that defines a compression chamber; and a gate rotor having a gear tooth that closes the compression chamber at a start of a compression cycle, travels through the compression chamber during the compression cycle, and exits the compression chamber at an end of the compression cycle;

wherein compression gasses within the compression chamber have a pressure, the pressure being equal to a suction pressure at the start of the compression cycle and increasing during the compression cycle to a discharge pressure at the end of the compression cycle;

wherein the outer wall of the cylindrical bore includes an oil injection port that injects oil into the compression chamber during a time period and stops injecting oil into the compression period at the end of the time period partially through the compression cycle, and an average pressure ratio of the pressure of the compression gasses within the compression chamber relative to the suction pressure during the time period is less than about 1.8:1.

2. The screw compressor of claim 1, wherein the main rotor includes a plurality of helical grooves and each helical groove defines a compression chamber.

3. The screw compressor of claim 2, wherein the compressor comprises two gate rotors, a first gate rotor being rotationally mounted within the compressor housing on a first side of the main rotor and a second gate rotor being rotationally mounted within the compressor housing on a second side of the main rotor opposite the first side.

4. The screw compressor of claim 1, wherein the average pressure ratio of the pressure of the compression gasses within the compression chamber relative to the suction pressure during the time period is about 1.2:1.

5. The screw compressor of claim 1, wherein the time period during which the oil injection port injects oil into the compression chamber begins prior to when the gear tooth closes the compression chamber at the start of the compression cycle.

6. The screw compressor of claim 1, wherein a pressure ratio of the pressure of the compression gasses within the compression chamber relative to the suction pressure is about 2.4:1 when the time period during which the oil injection port injects oil into the compression chamber ends.

7. The screw compressor of claim 1, wherein the oil injection port includes a single injection point, and does not include a plurality of oil injection points.

8. A compression system comprising:

an oil cooler that cools oil to be injected into a screw compressor;

an oil separator that separates oil from compression gasses generated by the screw compressor; and the screw compressor, wherein the screw compressor comprises:

a compressor housing that includes a cylindrical bore having an outer wall;

a main rotor rotationally mounted within the cylindrical bore of the compressor housing, the main rotor including at least one helical groove that defines a compression chamber; and a gate rotor having a gear tooth that closes the compression chamber at a start of a compression cycle, travels through the compression chamber during the compression cycle, and exits the compression chamber at an end of the compression cycle;

wherein compression gasses within the compression chamber have a pressure, the pressure being equal to suction pressure at the start of the compression cycle and increasing during the compression cycle to a discharge pressure at the end of the compression cycle;

wherein the outer wall of the cylindrical bore includes an oil injection port that injects oil into the compression chamber during a time period and stops injecting oil into the compression period at the end of the time period partially through the compression cycle, and an average pressure ratio of the pressure of the compression gasses within the compression chamber relative to the suction pressure during the time period is less than about 1.8:1.

9. The compression system of claim 8, wherein the compression system does not include an oil pump.

10. The compression system of claim 8, wherein the main rotor includes a plurality of helical grooves and each helical groove defines a compression chamber.

11. The compression system of claim 10, wherein the compressor comprises two gate rotors, a first gate rotor being rotationally mounted within the compressor housing on a first side of the main rotor and a second gate rotor being rotationally mounted within the compressor housing on a second side of the main rotor opposite the first side.

12. The compression system of claim 8, wherein the average pressure ratio of the pressure of the compression gasses within the compression chamber relative to the suction pressure during the time period is about 1.2:1.

13. The compression system of claim 8, wherein the time period during which the oil injection port injects oil into the compression chamber begins prior to when the gear tooth closes the compression chamber at the start of the compression cycle.

14. The compression system of claim 8, wherein a pressure ratio of the pressure of the compression gasses within the compression chamber relative to the suction pressure is about 2.4:1 when the time period during which the oil injection port injects oil into the compression chamber ends.

15. The compression system of claim 8, wherein the oil injection port includes a single injection point, and does not include a plurality of oil injection points.

16. A method of operating a screw compressor, the method comprising:

providing s screw compressor, wherein the screw compressor comprises:

a compressor housing that includes a cylindrical bore having an outer wall, the outer wall of the cylindrical bore including an oil injection port;

a main rotor rotationally mounted within the cylindrical bore of the compressor housing, the main rotor including at least one helical groove that defines a compression chamber; and a gate rotor having a gear tooth that closes the compression chamber at a start of a compression cycle, travels through the compression chamber during the compression cycle, and exits the compression chamber at an end of the compression cycle;

conducting a compression cycle, wherein compression gasses within the compression chamber have a pressure, the pressure being equal to suction pressure at the start of the compression cycle and increasing during the compression cycle to a discharge pressure at the end of the compression cycle; and injecting oil into the compression chamber through the oil injection port during a time period and stopping injecting oil into the compression period at the end of the time period partially through the compression cycle;

wherein an average pressure ratio of the pressure of the compression gasses within the compression chamber relative to the suction pressure during the time period is less than about 1.8:1.

17. The method of claim 16, wherein injecting oil into the compression chamber through the oil injection port during the time period includes beginning the time period prior to when the gear tooth closes the compression chamber at the start of the compression cycle.

18. The method of claim 16, wherein injecting oil into the compression chamber through the oil injection port during the time period includes ending the time period when a pressure ratio of the pressure of the compression gasses within the compression chamber relative to the suction pressure is about 2.4:1.

* * * * *